US006055961A

United States Patent [19]

Friedrich et al.

[11] Patent Number: 6,055,961

[45] **Date of Patent: *May 2, 2000**

[54] METHOD FOR MONITORING A FUEL PRESSURE

[75] Inventors: Arno Friedrich; Andreas Hartke, both of Regensburg; Klaus Wenzlawski, Nurenberg, all of Germany

[73] Assignee: Siemens Aktiengesellschaft, Munich, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/920,473

[22] Filed: Aug. 29, 1997

[30] Foreign Application Priority Data

Aug. 29, 1996 [DE] Germany ..... 196 34 982

[51] Int. Cl.[7] ..... F02M 37/04

[52] U.S. Cl. ..... 123/458

[58] Field of Search ..... 123/458, 198 D

[56] References Cited

U.S. PATENT DOCUMENTS 5,241,933 9/1993 Morikawa ..... 123/198 D

FOREIGN PATENT DOCUMENTS 0 501 459 A2 9/1992 European Pat. Off. .
4335171C1 5/1995 Germany .
4440700A1 6/1995 Germany .
95/06814 3/1995 WIPO .

*Primary Examiner*—Thomas N. Moulis
*Attorney, Agent, or Firm*—Herbert L. Lerner; Laurence A. Greenberg; Werner H. Stemer

[57] ABSTRACT

A method for monitoring a fuel pressure uses a trigger value or components of the trigger value, with which a pressure adjusting member is triggered. A pressure drop is detected if the trigger value or components thereof deviate from a value typical for that operating point.

9 Claims, 2 Drawing Sheets

METHOD FOR MONITORING A FUEL PRESSURE

BACKGROUND OF THE INVENTION

FIELD OF THE INVENTION

The invention relates to a method for monitoring a fuel pressure in a fuel line which is supplied with fuel through a pump, in which the fuel pressure in the fuel line is controlled through a pressure adjusting member.

In injection systems with a high fuel pressure, it is advantageous to monitor the fuel pressure, and if a line should break to lower the fuel pressure or output a signal.

German Published, Non-Prosecuted Patent Application DE 44 40 700 A1 discloses a method for protecting against the escape of fuel from a high-pressure line in a fuel system, in which damage in the fuel system is detected from a drop in line pressure, and the fuel pressure is immediately lowered by opening a pressure valve if the line pressure is dropping rapidly.

The above-described method has the disadvantage of requiring the pressure drops to be detected accurately and quickly, before a leak in the fuel system is detected. Detecting a corresponding pressure drop is relatively difficult, since the fuel system seeks to keep the fuel pressure constant, even in the event of a leak, and therefore the known method is relatively complicated and expensive in terms of measurement evaluation and moreover is relatively unreliable.

SUMMARY OF THE INVENTION

It is accordingly an object of the invention to provide a method for monitoring a fuel pressure, which overcomes the hereinafore-mentioned disadvantages of the heretofore-known methods of this general type and which quickly and reliably detects a pressure drop in a fuel line.

With the foregoing and other objects in view there is provided, in accordance with the invention, a method for monitoring a fuel pressure in a fuel line, which comprises supplying a fuel line with fuel through a pump; and controlling fuel pressure in the fuel line through a pressure adjusting member by comparing at least one component of a trigger value for triggering the pressure adjusting member with a comparison value; and detecting a pressure drop, in particular a leak, in the fuel line if at least the at least one component of the trigger value deviates from the comparison value by more than a predeterminable threshold value.

One particular advantage of the method of the invention resides in using not the fuel pressure itself but rather the trigger value or components of the trigger value, with which the fuel pressure is regulated, for detecting a pressure drop.

In accordance with another mode of the invention, there is provided a method which comprises using a controller value or components of the controller value as the at least one component of the trigger value.

In accordance with a further mode of the invention, there is provided a method which comprises comparing a course over time of at least one component of the trigger value with a corresponding comparison value.

In accordance with an added mode of the invention, there is provided a method which comprises detecting a pressure drop in the fuel line if the at least one component of the trigger value changes without changes in operating conditions on which the fuel pressure depends.

In accordance with an additional mode of the invention, there is provided a method which comprises detecting a pressure drop in the fuel line if the at least one component of the trigger value changes by more than a predetermined value within a predetermined time.

In accordance with yet another mode of the invention, there is provided a method which comprises detecting a pressure drop in the fuel line if the trigger value is above a predeterminable maximum value or below a predeterminable minimum value for a predetermined period of time.

In accordance with a concomitant mode of the invention, there is provided a method which comprises opening the pressure adjusting member after a fuel pressure drop is detected, for lowering the fuel pressure in the fuel line.

Other features which are considered as characteristic for the invention are set forth in the appended claims.

Although the invention is illustrated and described herein as embodied in a method for monitoring a fuel pressure, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
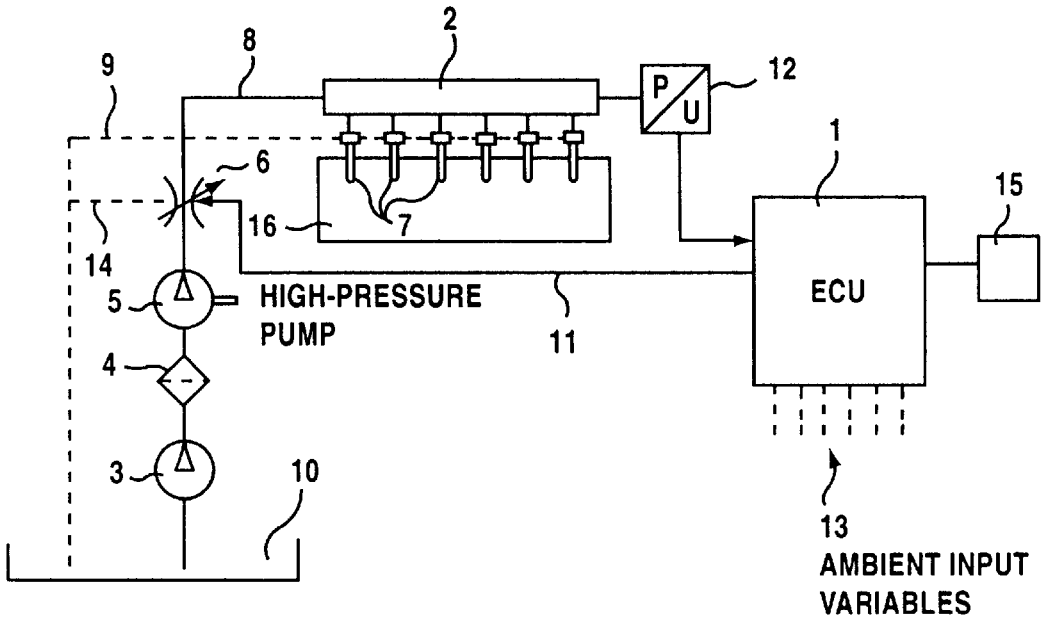
FIG. 1 is a schematic and diagrammatic view of a fuel injection system.

Referring now to the figures of the drawings in detail and first, particularly, to FIG. 1 thereof, there is seen an injection system with a fuel tank 10, which communicates through a prefeed pump 3 and a fuel filter 4 with a high-pressure pump 5 that pumps fuel at high pressure into a high-pressure line 8. The high-pressure line 8 is connected to an injection strip 2 that has injectors 7 which inject fuel into combustion chambers of an internal combustion engine 16. The injection strip 2 is preferably constructed as a high-pressure reservoir or common rail.

The high-pressure line 8 has a triggerable pressure adjusting member 6, which by way of example is a regulatable pump or a closed-loop control pressure valve, which communicates with the tank 10 through a first leakage line 14. The injectors 7 are connected to a second leakage line 9, which is likewise extended to the tank 10. The pressure adjusting member 6 is connected through a trigger line 11 to a control unit 1. The control unit 1 also communicates with a pressure sensor 12, which is disposed on the injection strip 2 and measures fuel pressure in the injection strip 2 and thus in a high-pressure region. The control unit 1 moreover has access to a memory 15 and has additional inputs 13, by way of which data from the engine, such as load or rpm, are delivered to the control unit 1.

The configuration of FIG. 1 functions as follows: In a simple exemplary embodiment, the high-pressure pump 5 is not regulatable in its capacity but instead compresses a constant quantity of fuel per unit of time, at a constant speed or rpm, to a predetermined high pressure and pumps the compressed fuel into the high-pressure line 8. The pressure that is available in the high-pressure line 8 and therefore in the injection strip 2 for the injection through the injectors 7 is specified by the control unit 1 by regulation of the pressure adjusting member 6.

The control unit 1 regulates the pressure in the high-pressure line 8 in accordance with the operating conditions of the motor vehicle, in particular the engine rpm and/or load, which are furnished to the control unit 1 through the additional inputs 13. The relationship between the operating conditions and the fuel pressure is stored in the memory 15 in the form of a one-dimensional or multidimensional data field. If the fuel pressure in the high-pressure line 8 exceeds a fuel pressure predetermined in the data field, then the control unit 1 opens the pressure adjusting member 6, and fuel flows back into the tank 10 through the leakage line 14.

A further reduction in the fuel pressure is effected through the injection through the injectors 7 and the leakage flow of fuel back to the tank 10 through the injectors 7 and the leakage line 9.

Figure 2:
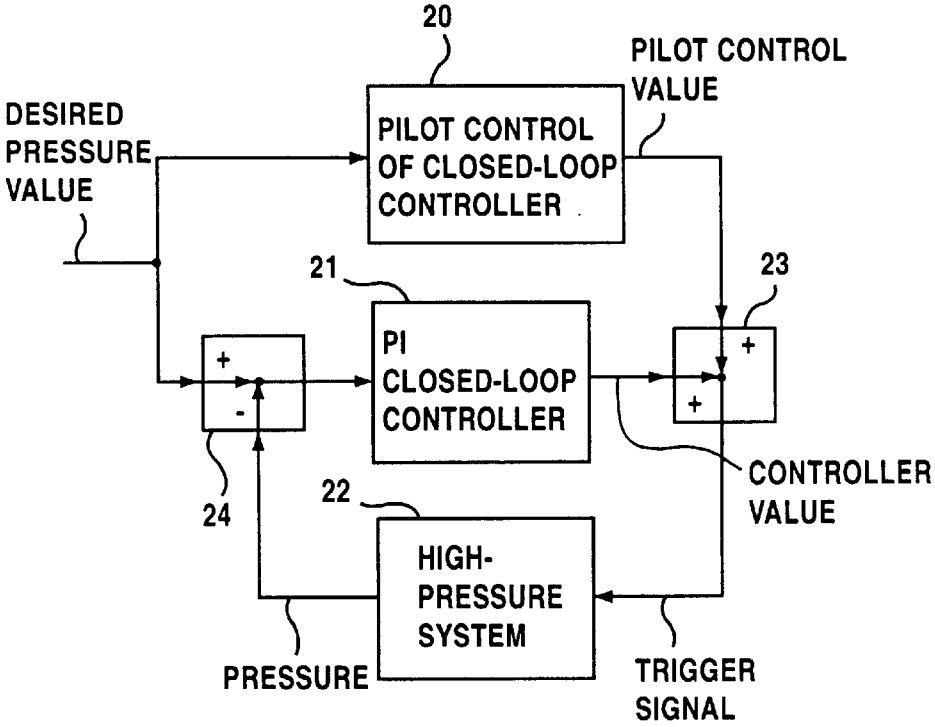
FIG. 2 is a block diagram illustrating a closed-loop control method.

The block circuit diagram of FIG. 2 shows the closed-loop control process by which the control unit 1 regulates the fuel pressure in the high-pressure line 8 and the injection strip 2. The control unit 1 finds a desired pressure value from the memory 15 in accordance with the motor vehicle operating conditions, in particular the load or rpm, and ascertains a pilot control value for the pressure adjusting member 6 from the desired pressure value, in a block 20.

The desired pressure value is compared by subtraction in a block 24 with the actual fuel pressure determined in the injection strip 2 by the pressure sensor 12, and the difference between the desired pressure value and the actual fuel pressure is delivered as a differential pressure value to a closed-loop controller 21, preferably a PI controller with a proportional and integral transmission member. This controller 21 ascertains a controller value TV from the differential pressure value by the following formula:

$$TV = K_p\left(P_{dif} + \frac{1}{T_n}\int P_{dif}\,dt\right)$$

where $P_{dif}$=differential pressure value $K_p$=a predeterminable amplification factor, and $T_n$=a predeterminable readjustment time.

In this exemplary embodiment, the controller value TV is a duty cycle, with which the control unit 1 triggers the pressure adjusting member 6. The amplification factor and the readjustment time are chosen as a function of the closed-loop control performance of the entire system.

The I component of the controller value is described by the following component:

$$K_p\left(\frac{1}{T_n}\int P_{dif}\,dt\right)$$

and the P component of the controller value is described by the following component:

$$K_p(P_{dif})$$

In a block 23, the pilot control value and the controller value are added to make a trigger value, which represents a trigger signal with which an action is exerted on a high-pressure system 22, or in other words the pressure adjusting member 6 is triggered accordingly.

In order to provide accurate, fast ascertainment of a pressure drop in the high-pressure system 22, that is in the high-pressure line 8 and the injection strip 2, it is advantageous to use the trigger value itself, or at least components of the trigger value, such as the controller value, or components of the controller value, such as the I component or the P component, to detect a pressure drop in the high-pressure line 8.

Figure 3:
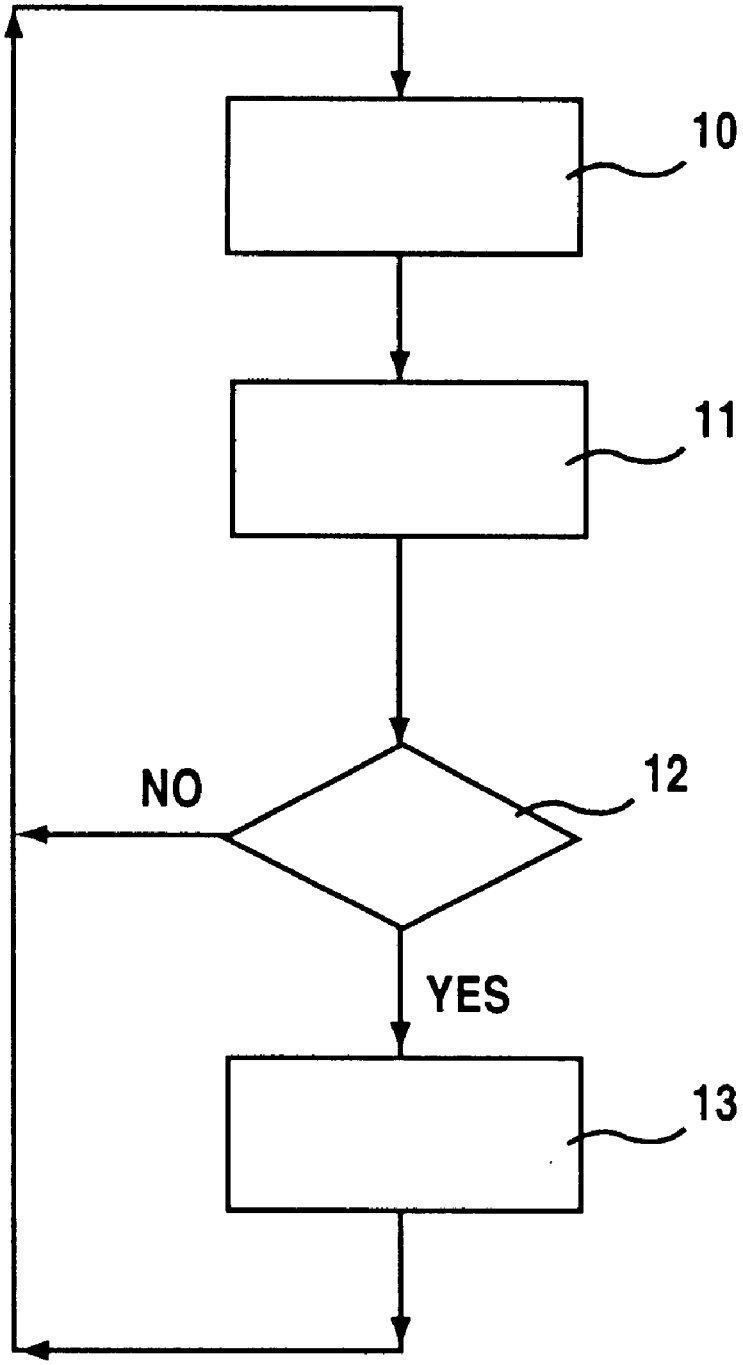
FIG. 3 is a flow chart of a program.

The evidence that a pressure drop is occurring in the high-pressure line 8 and the injection strip or line 2 will now be described in further detail in conjunction with FIG. 3:

At a program point 10, the control unit 1 according to FIG. 2 ascertains a trigger value from a desired pressure value dependent on operating conditions of the motor vehicle, in particular the engine rpm and load, and with this trigger value the pressure adjusting member 6 is triggered by the control unit 1 to regulate the fuel pressure in the high-pressure line 8.

At a program point 11, the control unit 1 compares the trigger value, preferably at least components of the controller value such as its I component or P component, with predetermined comparison values or comparison ranges that are typical for the current desired pressure value and/or engine operating conditions. To that end, suitable values and value ranges for the trigger value and components of the trigger value are entered in the memory 15 as a function of the desired pressure value and/or the operating conditions.

A further, advantageous monitoring of the trigger value or components of the trigger value is based on comparing the course over time of the trigger value and/or at least components of the trigger value, in particular components of the controller value, with predetermined comparison thresholds, which are preferably dependent on operating conditions of the motor vehicle and/on the desired pressure value, and which are preferably stored in the memory 15.

The values, value ranges and comparison thresholds specify comparison values that are typical for the corresponding operating range. A pressure drop in the injection strip 2 and the high-pressure line 8 is detected by the control unit 1 if the trigger value and/or components of the trigger value, in particular components of the controller value, deviate from the values, value ranges and comparison thresholds by more than a predeterminable threshold value.

The values, value ranges and comparison thresholds are ascertained by way of experiments or are calculated through simulation calculations and are preferably updated on an ongoing basis.

At a program point 12, the question is asked whether or not the trigger value and/or components of the trigger value, in particular components of the controller value, deviate from the values, value ranges and comparison thresholds by more than a predeterminable threshold value. If so, then the method goes to a program point 13.

In the program point 13, the control unit 1 detects an unusual pressure drop in the high-pressure line 8 or the injection strip 2 and thereupon opens the pressure adjusting member 6, so that the high fuel pressure in the high-pressure line 8 is reduced through the leakage line 14, and/or outputs an alarm signal, and/or enters an error code in the memory 15.

If the comparison in the program point 12 shows that the trigger value and/or components of the trigger value, in particular components of the controller value, do not deviate from the values, value ranges and comparison thresholds by more than a predeterminable threshold value, then a return to the program point 10 is made, and the control unit 1 finds that no unusual pressure drop is occurring.

In order to detect a pressure drop in the high-pressure line 8, as was described with regard to the program point 12, the course over time of the calculated trigger value or components of the trigger value, in particular the I component or P component of the control value, is preferably monitored, and a pressure drop is detected if the trigger value or components thereof change abruptly within a predetermined time by a predetermined value, or if the trigger value or components thereof on average have a value within a predetermined time that is above a predetermined comparison value.

Another indication of a pressure drop in the high-pressure line 8 is if the trigger value or at least components of the trigger value change without any change in the desired pressure value and/or motor vehicle operating conditions on which the fuel pressure depends, in particular the vehicle speed, engine rpm, or fuel pressure in the high-pressure line 8.

On the condition that no other operating conditions, such as the desired fuel pressure value, the engine rpm, the engine load, or the vehicle speed change within the predetermined time period, a pressure drop is detected:

if the trigger value during the predetermined period of time of preferably 20 ms changes by more than 10% in the positive direction, that is if the pressure adjusting member 6 is closed to a greater extent, so that less fuel can leave the high-pressure line 8, and/or if the controller value varies by more than 5% in the positive direction per period of time, which is 100 ms, and/or if the P component of the controller value varies by more than 5% in the positive direction per time period, and/or if the I component of the controller varies by more than 10% in the positive direction per time period.

If the operating parameters change within the predeterminable time period that is preferably 20 ms, then a pressure drop is detected:

if the controller value varies by more than 15% in the positive direction within the time period, and/or if the P component of the controller value varies by more than 15% within the time period, and/or if the I component of the controller value varies by more than 20% in the positive direction within 100 ms.

A pressure drop in the fuel line 8, 2 is preferably detected by the control unit 1 if the trigger value, over a predetermined time period, is above a predeterminable maximum value or below a predeterminable minimum value, with the maximum and minimum values and the time period being stored in the memory 15.

We claim:

1. A method for monitoring a fuel pressure in a fuel line, which comprises:

supplying a fuel line with fuel through a pump; controlling fuel pressure in the fuel line through a pressure adjusting member by;

calculating a trigger value having a plurality of components; and applying the trigger value to the pressure adjusting member;

detecting a pressure drop in the fuel line by:

repetitively comparing at least one of the plurality of components of the trigger value with a comparison value during a time period; and determining that there is a pressure drop in the fuel line if at least one of the plurality of components of the trigger value deviates from the comparison value by more than a predetermined threshold during the time period.

2. The method according to claim 1, which comprises detecting a leak in the fuel line causing the pressure drop.

3. The method according to claim 1, which comprises using a controller value as the at least one component of the trigger value.

4. The method according to claim 1, which comprises using components of a controller value as the at least one component of the trigger value.

5. The method according to claim 1, which comprises detecting a pressure drop in the fuel line if the at least one component of the trigger value changes without changes in operating conditions on which the fuel pressure depends.

6. The method according to claim 1, which comprises detecting a pressure drop in the fuel line if the at least one component of the trigger value changes by more than a predetermined value within a predetermined time.

7. The method according to claim 1, which comprises detecting a pressure drop in the fuel line if the trigger value is above a predeterminable maximum value for a predetermined period of time.

8. The method according to claim 1, which comprises detecting a pressure drop in the fuel line if the trigger value is below a predeterminable minimum value for a predetermined period of time.

9. The method according to claim 1, which comprises opening the pressure adjusting member after a fuel pressure drop is detected, for lowering the fuel pressure in the fuel line.

* * * * *